US007749948B2

(12) United States Patent
Bardasz et al.

(10) Patent No.: US 7,749,948 B2
(45) Date of Patent: Jul. 6, 2010

(54) NITROGEN-CONTAINING DISPERSANT AS AN ASHLESS TBN BOOSTER FOR LUBRICANTS

(75) Inventors: Ewa Bardasz, Mentor, OH (US); Virginia A. Carrick, Chardon, OH (US); John K. Pudelski, Cleveland Heights, OH (US); Renee A. Eveland, Concord Township, Lake County, OH (US); Douglas M. Barr, Hudson, OH (US); Matthew D. Gieselman, Willoughby Hills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 690 days.

(21) Appl. No.: 11/679,540

(22) Filed: Feb. 27, 2007

(65) Prior Publication Data

US 2007/0203031 A1 Aug. 30, 2007

Related U.S. Application Data

(60) Provisional application No. 60/777,141, filed on Feb. 27, 2006.

(51) Int. Cl.
*C10L 1/00* (2006.01)
*C10L 1/22* (2006.01)
*C10M 149/10* (2006.01)

(52) U.S. Cl. ..... 508/192; 508/221; 44/330; 44/331

(58) Field of Classification Search ..... 508/192, 508/221; 44/330, 331
See application file for complete search history.

(56) References Cited

U.S. PATENT DOCUMENTS

| | | | | |
|---|---|---|---|---|
| 3,172,892 | A | 3/1965 | Le Suer et al. | |
| 3,282,955 | A | 11/1966 | Le Suer | |
| 3,634,515 | A | 1/1972 | Piasek et al. | |
| 4,234,435 | A | 11/1980 | Meinhardt et al. | |
| 6,207,624 | B1 * | 3/2001 | Stachew et al. | 508/290 |
| 6,720,293 | B2 * | 4/2004 | Bovington et al. | 508/192 |
| 2005/0085399 | A1 * | 4/2005 | Burrington et al. | 508/287 |
| 2005/0202981 | A1 | 9/2005 | Eveland et al. | |

FOREIGN PATENT DOCUMENTS

| | | |
|---|---|---|
| EP | 1508610 | 2/2005 |
| GB | 1318874 | 5/1973 |
| GB | 1506786 | 4/1978 |
| WO | 2006047361 | 5/2006 |

OTHER PUBLICATIONS

Search Report of corresponding PCT Application No. PCT/US2007/062631 dated Oct. 8, 2007.
Written Opinion of corresponding PCT Application No. PCT/US2007/062631 dated Oct. 8, 2007.

* cited by examiner

*Primary Examiner*—Walter D Griffin
*Assistant Examiner*—Frank C Campanell
(74) *Attorney, Agent, or Firm*—David M. Shold; Christopher D. Hilker

(57) ABSTRACT

Lubricant compositions comprising (a) an oil of lubricating viscosity; and (b) at least one non-metal-containing additive, comprising a nitrogen-containing dispersant having a total base number of at least about 90 are useful for lubricating an internal combustion engine. The lubricants have less than 1.0% sulfated ash and a total base number of at least about 8.5, and at least 30% of the total base number of the composition is provided by non-metal-containing additives. The lubricants exhibit a high TBN without deterioration of elastomeric seals.

26 Claims, No Drawings

NITROGEN-CONTAINING DISPERSANT AS AN ASHLESS TBN BOOSTER FOR LUBRICANTS

BACKGROUND OF THE INVENTION

The present invention relates to lubricant compositions particularly for internal combustion engines. The lubricant contains a nitrogen-containing dispersant or TBN booster which provides a significant amount of the basicity of the composition.

Projected global engine emissions standards for the period up to 2010 and beyond will require significant changes in the formulations of crankcase oils, including crankcase oils for heavy duty diesel engines. There is, for instance, an emphasis on providing oils with significant reduction in sulfur, phosphorus, and sulfated ash (ASTM D-874.) However, such lower levels have serious impact on engine oils. Reduced ash levels, for examples, will necessitate a reduction in the amount of metallic detergent, which have been used to provide base to neutralize acidic fuel and lubricant degradation products. This neutralizing function is particularly important for use with extended oil drain intervals, where reduced detergent levels may jeopardize oil life.

Oil life may be extended by increasing the total base number (TBN, ASTM D-2896) of the oil. The challenge is to deliver TBN without adding ash or harming seal compatibility, particularly for Viton® fluorocarbon (fluoropolymer) seals, which is often a problem when basic nitrogen compounds are added. The present inventors have discovered that the addition of certain selected nitrogen-containing dispersants to lubricant formulations, especially low sulfur, low phosphorus, low ash diesel oil formulations can boost the TBN level of the lubricant without harming fluoropolymer seal compatibility or in some cases even improving fluoropolymer seal compatibility.

The lubricants of the present invention are useful for lubricating apparatus generally, but particularly for use as engine oils for internal combustion engines. These include passenger car engines, small engines, marine diesel engines, stationary gas engines, two-cycle and four-cycle engines, and engines fueled with gasoline, diesel fuel, organic fuels such as alcohol and hydrocarbon-alcohol mixtures, natural gas, and hydrogen, and sump-lubricated and fuel-lubricated engines. It is particularly suited for lubricating heavy duty diesel engines such as the type found in trucks. It is also suited for heavy duty diesel engines which are equipped with exhaust gas recirculation systems. Such systems may be used in efforts to reduce environmental emissions from such engines. Among the consequences of recirculating the exhaust gas through the engine are different soot structures and increased viscosity of the oil at lower soot levels, compared with engines without EGR. It is desirable that lubricating oils for such engines exhibit minimal viscosity increase, e.g., less than 12 $mm^2$/sec (cSt) at a soot loading of 6%. Diesel engines with EGR may also experience higher loadings of acidic products of combustion, imparted to the lubricant from the exhaust gases, so lubricants with high TBN levels are often desirable to effect neutralization of such acids.

SUMMARY OF THE INVENTION

The present invention provides a lubricant composition comprising (a) an oil of lubricating viscosity; and (b) at least one non-metal-containing additive, comprising a nitrogen-containing dispersant having a total base number of at least 90; said composition having less than 1.0% sulfated ash and a total base number of at least 8.5; wherein at least 30% of the total base number of the composition is provided by non-metal-containing additives.

The invention further provides a method for lubricating an internal combustion engine comprising supplying to said engine the foregoing lubricant.

The invention further provides a method for improving the seal compatibility of an engine oil composition which comprises an oil of lubricating viscosity and a succinimide dispersant having a N:CO ratio of less than 1.5:1 and a total base number of less than 90, comprising:

including within said engine oil composition at least one non-metal-containing additive, comprising a nitrogen-containing dispersant having a total base number of at least 90;

wherein said engine oil composition has less than 1.0% sulfated ash and a total base number of at least 8.5;

and wherein at least 30% of the total base number of the engine oil composition is provided by said non-metal-containing additives.

DETAILED DESCRIPTION OF THE INVENTION

Various preferred features and embodiments will be described below by way of non-limiting illustration.

The present invention thus provides a composition as described above. The lubricant composition will contain, first, an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; mono- and di-alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes and alkyldiphenyl alkanes; alkylated diphenyl ethers and alkylated diphenyl sulfides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch (i.e., gas-to-liquid) reactions and typically may be hydroisomerised Fischer-Tropsch hydrocarbons or waxes.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content <0.03 wt %, and >90 wt % saturates, viscosity index 80-120); Group III (sulfur content <0.03 wt %, and >90 wt % saturates, viscosity index >120); Group IV (all polyalphaolefins (PAOs)); and Group V (all others not included in Groups 1, II, III, or IV). The oil of lubricating viscosity comprises an API Group I, Group II, Group III, Group IV, Group V oil and mixtures thereof. Often the oil of lubricating viscosity is an API Group I, Group II, Group III, Group IV oil and mixtures thereof, Alternatively the oil of lubricating viscosity is often an API Group I, Group II, Group III oil or mixtures thereof, or, in certain embodiments, a Group III oil.

The lubricating oil in the invention will normally comprise the major amount of the composition. Thus it will normally be at least 50% by weight of the composition, such as 60 to 99%, or 83 to 98%, or 88 to 90%. As an alternative embodiment, however, the present invention can provide an additive concentrate in which the oil can be up to 80%, such as 30 to 80%, or 1 to 50% or to 20% by weight, or 2 to 10% by weight, and the other components, described in greater detail below, are proportionately increased.

The lubricant composition will also include at least one non-metal containing additive. A non-metal containing additive may also be referred to as an ashless additive, since it will typically not produce any sulfated ash when subjected to the conditions of ASTM D 874. An additives is referred to as "non-metal containing" if it does not contribute metal content to the lubricant composition. It is recognized, of course, that a non-metal containing additive will normally eventually be mixed with other material in a lubricant or in a concentrate, and certain of the other materials may be metal containing. If this happens, some of the metal ions from the other material may become associated with the non-metal containing material. However, such in-situ association is not intended to negate the identity of the additive in question as a non-metal containing additive. Thus, the additive is, more strictly speaking, non-metal containing prior to mixing with other components. The non-metal containing additive comprises a nitrogen-containing dispersant or TBN booster having a total base number (always expressed herein on a neat chemical basis, that is, without the diluent oil that is conventionally present) of at least 90 or alternatively at least 100, e.g. 100 to 145. In a related manner, if the dispersant is a succinimide dispersant, the saponification number (by a modified ASTM D 94 procedure) of the precursor hydrocarbyl-substituted succinic anhydride may be 100 to 140.

These materials may be alternatively referred to as dispersants or as TBN boosters. This is because the material will formally have the structure of a dispersant, that is, a polar, nitrogen-containing "head" and a non-polar, hydro-carbonaceous "tail." In order to most effectively function as a dispersant, that is, to aid in dispersing products of combustion or other contaminants within a lubricant, it will normally be desirable to properly determine and balance the nature and chain lengths of the head and tail portions. However, in the present invention, the materials in question need not always be designed to provide optimum dispersancy. That is, they may also be designed primarily to provide additional basicity to the formulation (measured as TBN, total base number, ASTM D-2896), and such materials may equally be described then, as TBN boosters. All such materials are intended to be included within the scope of this component of the present invention, and references herein to "the high TBN dispersant" should be so understood.

The high TBN nitrogen containing dispersant may thus be a succinimide dispersant, that is the condensation product of a hydrocarbyl-substituted succinic anhydride with a poly (alkyleneamine). Succinimide dispersants are very well known in the art of lubricant formulation and have a variety of chemical structures including typically

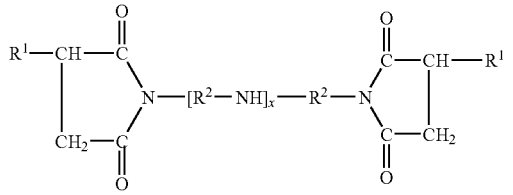

where each $R^1$ is independently an alkyl group, frequently a polyisobutylene group with a molecular weight of 300-5000 or 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892. Such materials may also contain ester linkages or ester functionality. Alternative acylating agents that may be reacted with amines include hydrocarbyl-substituted monocarboxylic acids, such as the reaction products of polyisobutylene with acrylic acid or with glyoxylic acid, and esters or hemiacetals thereof.

Another class of nitrogen-containing dispersant is Mannich bases. These are materials which are formed by the condensation of a higher molecular weight, alkyl substituted phenol, an alkylene polyamine, and an aldehyde such as formaldehyde. Such materials may have the general structure

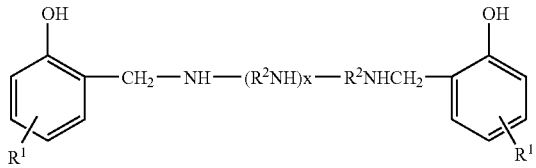

(including a variety of isomers and the like) and are described in more detail in U.S. Pat. No. 3,634,515.

Other nitrogen-containing dispersants include polymeric dispersant additives, which are generally hydrocarbon-based polymers which contain nitrogen-containing polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitrites, epoxides, boron compounds, and phosphorus compounds. References detailing such treatment are listed in U.S. Pat. No. 4,654,403.

The high TBN nitrogen-containing dispersant, particularly when it is a succinimide dispersant, may have an N:CO ratio of greater than 1.6:1. That is, there may be more than 1.6 nitrogen atoms in the dispersant (particularly those nitrogen atoms associated with an amide or imide function) for each carbonyl group in the dispersant. Suitable N:CO ratios include 1.6:1 to 2.2:1 or 1.7:1 to 2.1:1 or about 1.8:1.

The hydrocarbyl substituent on the succinimide dispersant may be a polyalkene with a number average molecular weight of 300 to 1500 or 500 to 1500. The hydrocarbyl substituent, moreover, may comprises a polybutene substituent. Suitable chain lengths of such substituents include 300 to 1000, 400 to 800, and 450 to 700 number average molecular weight units. In certain embodiments, the nitrogen-containing, dispersant may contain on average less than about 1.3 succinic groups per hydrocarbyl substituent, e.g., 1.0 to 1.2 or 1.05 to 1.15 such groups.

An amine is typically employed in preparing the high TBN nitrogen-containing dispersant. One or more poly(alkyleneamine)s may be used, and these may comprise one or more poly(ethyleneamine)s having 2 to 5 or 3 to 5 ethylene units and 3 to 6 or 4 to 6 nitrogens. Such materials include triethylenetetramine (TETA), tetraethylenepentamine (TEPA), and pentaethylenehexamine (PEHA). Such materials are typically commercially available as mixtures of various isomers containing a range number of ethylene units and nitrogen atoms, as well as a variety of isomeric structures, including various cyclic structures. The poly(alkyleneamine) may likewise comprise relatively higher molecular weight amines known in the industry as ethylene amine still bottoms.

The high TBN nitrogen-containing dispersant may also be a post-treated dispersant, as described above. Post-treated dispersants are obtained by reacting the nitrogen-containing dispersant with a reagent such as urea, thiourea, carbon disulfide, aldehydes, ketones, carboxylic acids, hydrocarbon-substituted succinic anhydrides, nitrites, epoxides, boron compounds, or phosphorus compounds. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422. In certain embodiments the dispersant is a borated dispersant. In certain embodiments the amount of boron in the borated dispersant is 0.25 or 0.5 to 3 percent by weight, or 1 to 2 percent by weight, e.g., 1.2 to 1.8%.

The amount of the high TBN nitrogen-containing dispersant in the lubricant composition in certain embodiments may be 0.1% to 11% by weight of the composition, or 0.1 to 7% or 0.3 to 4%, or 0.4 to 6 or 0.6 to 2.5%, or 1 to 3%, or about 2%. In certain embodiments, the high TBN nitrogen-containing dispersant may be present in an amount suitable to provide 1 to 5 or 1 to 3 TBN, or 1.5 to 2.5 TBN, or about 2 TBN, to the composition.

In addition to the high TBN nitrogen-containing dispersant, the lubricant composition may additionally contain a succinimide dispersant having a N:CO ratio of less than about 1.5:1, for instance 1.1:1 to 1.4:1 or about 1.3:1. The TBN of such a dispersant will typically be less than that of the high TEN dispersant, i.e., less than 90 or less than 80 or 70 or 50 or 40. This dispersant may contain on average 1.4 to 2.0 succinic groups per hydrocarbyl substituent, or 1.5 to 1.8, or about 1.6 succinic groups. In certain embodiments, this additional dispersant may bear a hydrocarbyl substituent of number average molecular weight of greater than about 1500 to about 3000 units, for instance, 2000 to 2500 or about 2200. In other respects, any additional succinimide dispersant may be substantially as described for the high TBN dispersant, above (for example, it may be borated or prepared with any of the above-mentioned amines).

This additional succinimide dispersant (or dispersants) may be present, if desired, in an amount of up to 6% by weight of the composition, for instance, 0.3% to 6.0% or 1 to 5% or 2 to 4% or about 3.6%. The amount of the additional succinimide dispersant(s) may be present, in certain embodiments, in amounts that are roughly similar to the amounts of the high TBN dispersant. In some embodiments the additional dispersant(s) will contribute less TBN to the finished lubricant than does the high TBN dispersant.

The total amount of the non-metal-containing additives will be an amount suitable to impart or provide at least 30% of the entire TBN to the composition, and in certain embodiments 30 to 60% or more, or 30 to 50%, or 35 to 47%. The remainder of the TBN (if any) may be provided by metal-containing additives such as, for example, detergents. The TBN of the entire lubricant composition should be at least 8.5 or 9, e.g., 8.5 to 13 or 9 to 11.

Often the composition has a total sulphur content up to or below 0.5 percent (by weight), or up to 0.4% or up to 0.3%, or 0.2 or 0.1%, or near 0%. Some embodiments may have lower limits of sulphur of 0.01%, 0.05%, or 0.1%. One possible source of sulphur in the composition of the invention may be diluent oil which may be used in the manufacturing processes for preparing many of the additives including the nitrogen containing dispersants. Excluding the diluent oil, the composition of the invention may have a lower sulfur content such as 700 ppm or less, or 600 ppm or less, or 300 ppm or less, or 100 ppm, 50 ppm, 30 ppm, 25 ppm, 20 ppm or 15 ppm or less. When sulfur from the diluent oil is included, the sulfur content of the composition may be increased by up to 800 ppm, such as up to 600 ppm, or up to 400, 300, or 200 ppm.

Often the composition has a total phosphorus content of up to 0.12 percent by weight, or up to 0.1%, or up to 0.085 wt %, or up to 0.07 or 0.055 or 0.05 wt % of the composition, such as 200 ppm or less, or 100 ppm, 50 ppm, or 10 ppm or less. In certain embodiments, phosphorus is present from 1 ppm or 10 ppm to 50 ppm or 200 ppm, or alternatively 0.01 to 0.08 weight percent.

Often the composition has a total ash content as determined by ASTM D-874 of less than 1.0 wt %, such as equal to or less than 0.8 wt % or 0.5 wt % of the composition. In certain embodiments the total ash content is 0.1 wt % or 0.2 wt % to 0.6 wt % or 0.7 wt %. In certain embodiments the ash may be provided by detergents or other materials containing calcium or magnesium metal or both, or other Group II metals, or by or other metals such as sodium or potassium or other Group I metals, or by other metals, or combinations thereof. A certain amount of ash may also be provided by the presence of boron compounds.

The lubricant compositions of the present invention may further comprise additional additives which may be conventionally used in formulating lubricating compositions. Thus they may contain one or more of viscosity modifiers, dispersant viscosity modifiers, friction modifiers, detergents, antioxidants, anti-wear agents, corrosion inhibitors, anti-rust agents, seal-swell agents, anti-foam agents, pour point depressants, extreme pressure agents, fluidity modifiers, copper passivators, and dispersants other than the above-described high TBN dispersant, that is, a nitrogen-containing dispersant having a total base number of at least about 90.

Viscosity modifiers generally are polymeric materials characterized as being hydrocarbon-based polymers generally having number average molecular weights between 25,000 and 500,000, e.g., between 50,000 and 200,000.

Hydrocarbon polymers can be used as viscosity index improvers. Examples include homopolymers and copolymers of two or more monomers of $C_2$ to $C_{30}$, e.g., $C_2$ to $C_8$ olefins, including both alphaolefins and internal olefins, which may be straight or branched, aliphatic, aromatic, alkyl-aromatic, or cycloaliphatic. Examples include ethylene-propylene copolymers, prepared by copolymerizing ethylene and propylene by known processes.

Hydrogenated styrene-conjugated diene copolymers are another class of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene. Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of $C_{4-18}$ alcohols also are useful as viscosity modifying additives in motor oils. Likewise, polymethacrylates (PMA) are used as viscosity modifiers. These materials are typically prepared from mixtures of methacrylate monomers having different alkyl groups, which may be either straight chain or branched chain groups containing 1 to 18 carbon atoms.

When a small amount of a nitrogen-containing monomer is copolymerized with alkyl methacrylates, dispersancy properties are incorporated into the product. Thus, such a product has the multiple function of viscosity modification, pour point depressancy and dispersancy and are sometimes referred to as dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers. Dispersant viscosity modifiers may also be interpolymers of ethylene and propylene which are grafted with an active monomer such as maleic anhydride and then derivatized with an alcohol or an amine or grafted with nitrogen compounds. Suitable amines include aromatic amines such as those disclosed in US Application 2006-0025316. Examples of dispersant viscosity modifiers are found in the aforementioned application as well as in WO 2005/103093 and WO 2005/087821.

Detergents are often overbased salts. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Also included are salixarate detergents, which include overbased materials prepared from salicylic acid (which may be unsubstituted) with a hydrocarbyl-substituted phenol, such entities being linked through —CH2- or other alkylene bridges. It is believed that the salixarate derivatives have a predominantly linear, rather than macrocyclic, structure, although both structures are intended to be encompassed by the term "salixarate." Salixarate derivatives and methods of their preparation are described in greater detail in U.S. Pat. No. 6,200,936 and PCT Publication WO 01/56968. Detergents of various any of the foregoing types may also be post-treated, e.g., by a boron reactant as in the case of borated dispersants.

Antioxidants encompass phenolic antioxidants, which may be of the general the formula

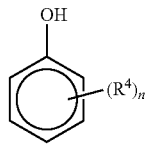

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups, such as

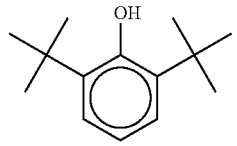

The para position may also be occupied by a hydrocarbyl group or a group bridging two aromatic rings. In certain embodiments the para position is occupied by an ester-containing group, such as, for example, an antioxidant of the formula

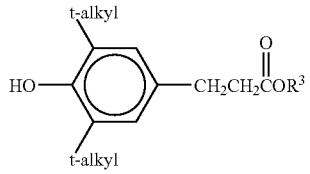

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Such antioxidants are described in greater detail in U.S. Pat. No. 6,559,105.

Antioxidants also include aromatic amines, such as those of the formula

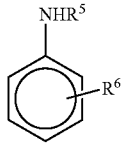

wherein $R^5$ can be a phenyl group or a phenyl group substituted by $R^7$, and $R^6$ and $R^7$ can be independently a hydrogen or an alkyl group containing 1 to 24 or 4 to 20 or 6 to 12 carbon atoms. In one embodiment, an aromatic amine antioxidant can comprise an alkylated diphenylamine such as nonylated diphenylamine of the formula

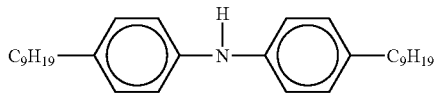

or a mixture of a di-nonylated amine and a mono-nonylated amine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the present invention include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

Molybdenum compounds can also serve as antioxidants, and these materials can also serve in various other functions, such as antiwear agents. The use of molybdenum and sulfur containing compositions in lubricating oil compositions as antiwear agents and antioxidants is known. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition.

Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. In certain embodiments the antioxidant can be an alkylated diphenyl amine. In certain embodiments that or another antioxidant can be present in amounts of 0.1 to 0.85 percent by weight.

When present in the invention, the friction modifier can be a monoester of a polyol and an aliphatic carboxylic acid, often an acid containing 12 to 24 carbon atoms. The monoester of a polyol and an aliphatic carboxylic acid may be in the form of a mixture with a sunflower oil or another natural oil, which may be present in the friction modifier mixture at 5 to 95, or 10 to 90, or 20 to 85, or 20 to 80 weight percent of the mixture.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol.

Aliphatic carboxylic acids which form the esters include those acids containing 12 to 24 carbon atoms. Acids containing straight chain hydrocarbyl groups containing 12 to 24 carbon atoms are suitable for instance, 14 to 20 or 16 to 18 carbon atoms. Such acids can be used in combination with acids with more or fewer carbon atoms as well. Generally the acid is a monocarboxylic acid, such as dodecanoic acid, stearic acid, lauric acid, behenic acid, or oleic acid.

The esters used in the present invention may be the monoesters of such polyols and such carboxylic acids. One such ester is glycerol monooleate. It is to be understood that glycerol monooleate, as is the case with other such materials, in its commercially available grade, is a mixture which includes such materials as glycerol, oleic acid, other long chain acids, glycerol dioleate, and glycerol trioleate. The commercial material is believed to include about 60±5 percent by weight of the chemical species "glycerol monooleate," along with 35±5 percent glycerol dioleate, and less than about 5 percent trioleate and oleic acid. The amounts of the monoesters, described below, are calculated based on the actual, corrected, amount of polyol monoester present in any such mixture.

Other friction modifiers that are suitable for the invention include fatty amines, fatty phosphites, fatty acid amides, fatty epoxides, alkoxylated fatty amines, metal salts of fatty acids, sulfurised olefins, fatty imidazolines, condensation products of carboxylic acids and polyalkylene-polyamines, amine salts of alkylphosphoric acids.

When present, the friction modifier may be present on an oil free basis at 0.01 to 20, or 0.05 to 10, or 0.1 to 5, or 0.2 to 3 or 0.5 to 2 weight percent of the composition.

Friction modifiers may to some extent overlap with the category of antiwear agents. Suitable antiwear agents include phosphoric acid esters or salt thereof; phosphites; and phosphorus-containing carboxylic esters, ethers, and amides or mixtures thereof. In one embodiment, the composition is substantially free of phosphorus- and/or sulphur-containing antiwear agents; or the composition may contain such agents.

The lubricant may thus contain a metal salt of a phosphorus acid. Metal salts of the formula $$[(R^8O)(R^9O)P(=S)—S]_n\text{-}M$$

where $R^8$ and $R^9$ are independently hydrocarbyl groups containing 3 to 30 carbon atoms, are readily obtainable by heating phosphorus pentasulfide ($P_2S_5$) and an alcohol or phenol to form an O,O-dihydrocarbyl phosphorodithioic acid. The alcohol which reacts to provide the $R^8$ and $R^9$ groups may be a mixture of a secondary alcohol and a primary alcohol, for instance, a mixture of isopropanol and 4-methyl-2-pentanol. The resulting acid may be reacted with a basic metal compound to form the salt. The metal M, having a valence n, generally is aluminum, lead, tin, manganese, cobalt, nickel, zinc, or copper, and in many cases, zinc, to form zinc dialkyldithiophosphates. Such materials are well known and readily available to those skilled in the art of lubricant formulation.

In one embodiment of the invention the antiwear agent is a borate ester. The borate ester may be prepared by the reaction of a boron compound and at least one compound selected from epoxy compounds, halohydrin compounds, epihalohydrin compounds, alcohols and mixtures thereof. Typically the alcohols include monohydric alcohols, dihydric alcohols, trihydric alcohols or higher alcohols.

Boron compounds suitable for preparing the borate ester include boric acid (including metaboric acid, $HBO_2$, orthoboric acid, $H_3BO_3$, and tetraboric acid, $H_2B_4O_7$), boric oxide, boron trioxide, and alkyl borates. The borate ester may also be prepared from boron halides. The borated ester may contain at least one hydrocarbyl group often containing 8 to 30 carbon atoms.

A related class of friction modifiers/antiwear agents includes borated epoxides, which are described in detail in U.S. Pat. No. 4,584,115, and are generally prepared by reacting an epoxide with boric acid or boron trioxide. Borated epoxides are not actually epoxides, but are the boron-containing reaction products of epoxides and may be typically borate esters. The epoxides can be commercial mixtures of $C_{14-16}$ or $C_{14-18}$ epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemicals. The borated compounds may be prepared by blending the boron compound and the epoxide and heating them at a suitable temperature, typically 80° to 250° C., optionally in the presence of an inert liquid medium, until the desired reaction has occurred. A suitable borated epoxide is the borated epoxide of a predominantly 16 carbon olefin.

In another embodiment the antiwear agent can be a fatty amide. This can be an amide based on the condensation of a fatty amine as described above with a carboxylic acid, or the condensation of a fatty acid with ammonia or an amine. An illustrative fatty amide is oleamide.

Often the antiwear agent is present on an oil free basis from 0 to 10, in one aspect 0.01 to 5, in another aspect 0.02 to 2 and in yet another aspect 0.05 to 1 or 0.1 to 0.5 weight percent of the composition. A borate ester may be present, for instance, in an amount of 0.1-0.5%. The antiwear agent may be used alone or in combination with other materials.

Certain of the above-described components, whether a borated dispersant, a borated detergent, a borate ester, or a borated epoxide, may contain boron. If a boron-containing material is present, the lubricant composition may in certain embodiments contain up to 1000 ppm of boron, for instance, 10 ppm to 900 ppm boron, or 20 ppm to 800 ppm, or 25 ppm to 600 ppm, or 25 to 200 ppm boron.

Thus, there is provided a method for lubricating an internal combustion engine, comprising supplying to said engine the lubricant composition as described above. The engine may be a heavy duty diesel engine and may be equipped with exhaust gas recirculation. There is also provided a method for improving the seal compatibility of an engine oil composition which comprises an oil of lubricating viscosity and a succinimide dispersant having a N:CO ratio of less than about 1.5:1 and a total base number of less than about 90, comprising: including within said engine oil composition at least one non-metal-containing additive, comprising a nitrogen-containing dispersant having a total base number of at least about 90; wherein said engine oil composition has less than 1.0% sulfated ash and a total base number of at least about 8.5; and wherein at least about 30% of the total base number of the engine oil composition is provided by said non-metal-containing additives. Likewise, there is provided a method for increasing the TBN of such a lubricating composition without the seal performance thereof, by including therein at least one non-metal-containing, additive, comprising a nitrogen-containing dispersant having a total base number of at least about 90

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Reference

A baseline lubricant formulation is prepared of the following components:

50.1% 260 N mineral oil 21.5% 130 N mineral oil

15% styrene/isoprene polymer viscosity index modifier, incl. 94% diluent oil 0.2% pour point depressant, including 54% diluent oil 7.2% succinimide dispersant, incl. 50% dil. oil, 27 TBN, N:CO ratio 1.3-1.6:1.

1.5% overbased calcium sulfonate detergents, including ~44% diluent oil 1.08% overbased calcium alkylphenol sulfide detergents, incl. ~35% dil. oil 0.15% alkyl aromatic amine antioxidant 0.16% sulfurized olefin antioxidant 1.2% hindered phenolic ester antioxidant 0.02% thiadiazole corrosion inhibitor 0.98% zinc dialkyldithiophosphate, including 9% diluent oil 0.01% siloxane antifoam agent, including 90% diluent oil 1.01% additional diluent oil Examples 2-10

To the above baseline lubricant formulation is added an amount, as indicated in the following table, of a high TBN nitrogen containing dispersant. This dispersant is, in particular, a succinimide material prepared by condensation of about 6.5 parts by weight of a polyisobutene-substituted succinic anhydride ($M_n$ about 1000) with 1 part by weight of commercial tetraethylenepentamines (TEPA). This dispersant has a TBN of about 100 in a concentrate containing 14% oil, or about 116 on an oil free basis, as reported in the table below (The "High TBN dispersant"). This is in addition to the conventional dispersant which is already present in the baseline formulation.

Reference Examples 11-13

For comparison purposes, a series of formulations are also prepared by adding to the same baseline formulation (which contains the 7.2% succinimide dispersant), the additional amounts indicated of a conventional succinimide dispersant, prepared from about 13.2 parts by weight of a polyisobutene ($M_n$ about 2000)-substituted succinic anhydride and 1 part by weight of a mixture of polyethylene polyamines. The reference dispersant has a TBN of about 27 in a concentrate containing 50% oil, or about 54 on an oil free basis, as reported below.

The experimental samples are tested for their effect on Viton™ fluorocarbon specimens by the MB (Mercedes Benz™) test and the MTU (MTU Friedrichshafen) test. The MB test involves immersing a fluorocarbon elastomer in a beaker containing 350 mL of the sample to be evaluated and heating it to 150° C. for 168 hours. The change in tensile strength of the sample after treatment is measured. The MTU test is similar but uses a different specific fluorocarbon elastomer specimen. For each test, results closer to zero indicate better seal compatibility.

| Ex. | Added dispersant, % | TBN: calc'd (measured) | MB test: % change in T/S | MTU test: % change in T/S |
|---|---|---|---|---|
| 1 baseline | No added high TBN dispersant | 8.1 (8.1) | −58.3 | −51.1 |
| 2 | 0.37 | 8.5 (8.5) | −56.6 | −52.6 |
| 3 | 0.73 | 8.9 (8.9) | −53.2 | −50.7 |
| 4 | 1.10 | 9.3 (9.3) | −52.5 | −54.5 |
| 5 | 1.46 | 9.8 (9.6) | −48.4 | −49.5 |
| 6 | 2.6 | 11.1 (10.9) | −45.5 | −52.8 |
| 7 | 3.4 | 12.1 (11.9) | −47.0 | −44.9 |
| 8 | 4.3 | 13.1 (13.0) | −43.5 | −44.3 |
| 9 | 5.2 | 14.1 (13.9) | −42.5 | −44.7 |
| 10 | 6.0 | 15.1 (14.9) | −45.4 | −44.2 |
| Ref.§, baseline | No added conventional dispersant | 8.1 (—) | −47.1 | −45.2 |
| Ref. 11 | 0.6 | 8.4 (—) | −48.1 | −52.0 |
| Ref. 12 | 1.1 | 8.7 (—) | −49.4 | −53.6 |
| Ref. 13 | 1.6 | 8.9 (—) | −48.5 | −54.3 |

§same formulation as for Ex. 1 baseline, re-run for direct comparison with Reference Examples 11-13.
— not determined The results show that in the MB test, addition of the high TBN dispersant leads to an unexpected improvement in the test results, that is, a lessening of reduction in the tensile strength of the elastomer sample. In contrast, when a conventional dispersant is added, there is little change or a slight worsening of elastomer performance. In the MTU test, the high TBN dispersant again leads to improved properties, although of a somewhat smaller magnitude. And in the MTU test, the presence of the added conventional dispersant leads to a significant deterioration of seal properties.

Example 14 and Reference Example 15 (Baseline Formulation)

In a similar test in which none of the conventional dispersant is present in the baseline formulation, a sample (Ex. 14) containing 2.6% of the same high TBN dispersant of Example 2 (overall TBN of the formulation=9.1), the results show MTU Viton™ tensile strength results of −47%. This is in comparison with +1.4% for the baseline Ref. Ex. 15, containing no nitrogen-containing dispersant whatsoever, a commercially non-viable formulation (overall TBN 6.1). The results of Example 14 may be compared with those of Example 6, illustrating that the presence of the high TBN dispersant does not lead to further deterioration in seal properties when it is added to a composition in which a dispersant is already present.

Examples 16 and 17 and Reference Example 18

In another similar test, the seal performance of fluids containing the high TBN dispersant, a conventional dispersant, and a mixture of these dispersants was evaluated, at equal amounts of dispersant (6.15%, active chemical basis), but differing TBN levels. Data is presented in the following Table:

| | Ex. 16 | Ex. 17 | Ref. Ex. 18 |
|---|---|---|---|
| High TBN dispersant, % | 6.15 | 2.55 | |
| Conventional dispersant, % | | 3.60 | 6.15 |
| TBN, calculated (measured) | 13.3 (13.3) | 11.1 (11.3) | 9.4 (9.7) |
| MB test, % change in T/S | −51.0 | −53.5 | −59.7 |
| MTU test, % change in T/S | −48.1 | −47.9 | −54.6 |

The results from examples 14-18 suggest that the beneficial effects of the high TEN dispersant are more apparent in fluids whose seal performance is already degraded by the presence of a conventional dispersant. Once a nitrogen-containing dispersant is already present in a formulation, the high TBN dispersant can be added, contributing additional TBN without further harming seals.

Examples 19 and 20

To the same baseline formulation as that of Example 1 there is added 1.72 percent by weight of the dispersant of Examples 2-10 (2 percent including diluent oil)—Example 19; or 1.72 percent by weight of a similar dispersant (2 percent by weight including diluent oil)—Example 20. The dispersant of example 20 has a TBN (oil containing) of 103, or 120 on an oil-free basis, and is prepared using a heavier cut of polyamine, also referred to as ethylene amine still bottoms. The percent change in tensile strength by the MB test is −47.7 for Example 19 and −53.1 for Example 20. Both examples exhibit improved results compared with an untreated baseline; the material prepared with tetraethylenepentamine as the amine component of the dispersant appears to exhibit superior performance to that prepared with the polyamine still bottoms. This result is unexpected since it conventional belief that dispersants prepared from TEPA as the amine source are more aggressive to fluoroelastomer seals than are dispersants prepared from ethylene amine still bottoms.

Example 21 (Reference) and Examples 22 to 25

A second, lower molecular weight, high TBN succinimide material is prepared by condensing about 3.1 parts by weight of a polyisobutene-substituted succinimide anhydride (Mn about 490) with 1 part by weight of commercial tetraethylenepentaamines (TEPA). The product has a TBN of about 216 in a concentrate containing 13.5% oil, which corresponds to about 250 on an oil-free basis. This lower molecular weight material, as well as the original higher molecular weight material used in Examples 2-10 are evaluated in a baseline formulation different from that of Example 1. This different baseline formulation, designated Reference Example 21, contains larger amounts of the low TBN dispersant, the detergent(s), and the zinc dialkyldithiophosphate, and a different ratio among the antioxidants, compared with Example 1. Moreover, the formulation of Example 21 also contains a dispersant viscosity modifier. This formulation is known to cause more severe seat degradation than the baseline formulation of Example 1. Hence the test results from Examples 22 through 25 cannot be directly compared with the earlier examples.

Varying amounts of the higher and lower $M_n$ high TBN materials are added to the baseline formulation of Example 21 and the fluoropolymer seal performance is evaluated by the MB Test, as described above. The results are reported in the table below:

| Example | Added dispersant, % | TBN of fluid: calc'd (measured) | MB test: % change in TS |
|---|---|---|---|
| 21 (ref) | none (baseline) | 8.3 (8.4) | −60.2 |
| 22 | Higher $M_n$, high TBN, 3.35 | 12.4 (12.1) | −67.2 |
| 23 | Higher $M_n$, high TBN, 1.67 | 10.4 (10.1) | −65.0 |
| 24 | Lower $M_n$, high TBN, 1.60 | 12.4 (11.3) | −59.2 |
| 25 | Lower $M_n$, high TBN, 0.8 | 10.4 (9.8) | −66.7 |

The result show that, in all instances, the high TBN dispersant may be added without significantly harming the seal performance of this severe baseline fluid. Moreover, at equal treat levels, (1.60-1.67%), the lower molecular weight material provides better seal performance, while contributing a higher level of TBN to the formulation.

It should be understood that the performance reported herein focuses on fluoroelastomer seals, which are recognized as being susceptible to degradation in the presence of conventional nitrogen-containing dispersants. Performance of seals of other chemical compositions will, naturally, be expected to depend on other variables and may be differently affected.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) an oil of lubricating viscosity; and (b) at least one non-metal-containing additive, comprising a nitrogen-containing dispersant having a total base number of at least about 90;

said composition having less than 1.0% sulfated ash and a total base number of at least about 8.5;

wherein at least about 30% of the total base number of the composition is provided by non-metal-containing additives.

2. The lubricant composition of claim 1 wherein said composition contains up to about 0.12 percent by weight phosphorus and up to about 0.5 percent by weight sulfur.

3. The lubricant composition of claim 1 wherein said at least one non-metal-containing additive (b) comprises a succinimide dispersant, being the condensation product of a hydrocarbyl-substituted succinic anhydride with a poly(alkyleneamine) and having an N:CO ratio of greater than about 1.6:1.

4. The lubricant composition of claim 3 wherein the hydrocarbyl substituent on the succinimide dispersant (b) is a polyalkene with a number average molecular weight of about 300 to about 1500.

5. The lubricant composition of claim 3 wherein the hydrocarbyl substituent of the succinimide dispersant (b) comprises a polybutene and the dispersant (b) contains on average less than about 1.3 succinic groups per hydrocarbyl substituent.

6. The lubricant composition of claim 3 wherein the poly (alkyleneamine) of the succinimide dispersant (b) comprises one or more poly(ethyleneamine)s having 2 to 5 ethylene units and 3 to 6 nitrogens.

7. The lubricant composition of claim 3 wherein the succinimide dispersant (b) has an N:CO ratio of about 1.7:1 to about 2.1:1.

8. The lubricant composition of claim 3 wherein the succinimide dispersant (b) is a borated dispersant.

9. The lubricant composition of claim 3 wherein the borated dispersant comprises about 0.25 to about 3% boron.

10. The lubricant composition of claim 3 wherein the composition comprises about 10 ppm to about 900 ppm boron.

11. The lubricant composition of claim 3 wherein the succinimide dispersant (b) is present in an amount of about 0.1% to about 11% by weight.

12. The lubricant composition of claim 1 wherein the nitrogen containing dispersant (b) is present in an amount suitable to provide about 1 to about 5 total base number to the composition.

13. The lubricant composition of claim 1 wherein the lubricant composition has a total base number of about 8.5 to about 13.

14. The lubricant composition of claim 1 further comprising:

(c) a succinimide dispersant having a N:CO ratio of less than about 1.5:1 and a total base number of less than about 90.

15. The lubricant composition of claim 14 wherein the succinimide dispersant (c) bears a hydrocarbyl substituent of number average molecular weight of greater than about 1500 to about 3000.

16. The lubricant composition of claim 15 wherein the succinimide dispersant (c) contains on average about 1.4 to about 2.0 succinic groups per hydrocarbyl substituent.

17. The lubricant composition of claim 15 wherein the succinimide dispersant (c) has an N:CO ratio of about 1.1:1 to about 1.4:1.

18. The lubricant composition of claim 15 wherein the succinimide dispersant (c) is present in an amount of about 0.3% to about 6.0% by weight.

19. The lubricant composition of claim 1 further comprising at least one viscosity modifier, dispersant viscosity modifier, friction modifier, detergent, antioxidant, anti-wear agent, corrosion inhibitor, anti-rust agent, seal-swell agent, anti-foam agent, pour point depressant, extreme pressure agent, fluidity modifier, copper passivator, or dispersant other than a nitrogen-containing dispersant having a total base number of at least about 90.

20. The lubricant composition of claim 1 wherein the amount of the oil of lubricating viscosity is about 60 to about 98 percent by weight.

21. The lubricant composition of claim 1 wherein the amount of the oil of lubricating viscosity is about 30 to about 80 percent by weight.

22. A composition prepared by admixing the components of claim 1.

23. A method for lubricating an internal combustion engine, comprising supplying to said engine the lubricant composition of claim 1.

24. The method of claim 23 wherein the internal combustion engine is a heavy duty diesel engine.

25. The method of claim 24 wherein the heavy duty diesel engine is equipped with exhaust gas recirculation.

26. A method for improving the seal compatibility of an engine oil composition which comprises an oil of lubricating viscosity and a succinimide dispersant having a N:CO ratio of less than about 1.5:1 and a total base number of less than about 90, comprising:

including within said engine oil composition at least one non-metal-containing additive, comprising a nitrogen-containing dispersant having a total base number of at least about 90;

wherein said engine oil composition has less than 1.0% sulfated ash and a total base number of at least about 8.5;

and wherein at least about 30% of the total base number of the engine oil composition is provided by said non-metal-containing additives.

* * * * *